US006962673B2

(12) United States Patent
Hattori et al.

(10) Patent No.: US 6,962,673 B2
(45) Date of Patent: Nov. 8, 2005

(54) HEAT-RESISTANT, CREEP-RESISTANT ALUMINUM ALLOY AND BILLET THEREOF AS WELL AS METHODS OF PREPARING THE SAME

(75) Inventors: Hisao Hattori, Itami (JP); Terukazu Tokuoka, Itami (JP); Takatoshi Takikawa, Itami (JP)

(73) Assignee: Sumitomo Electric Sintered Alloy, Ltd., Nariwa-cho (JP)

( * ) Notice: Subject to any disclaimer, the term of this patent is extended or adjusted under 35 U.S.C. 154(b) by 0 days.

(21) Appl. No.: 10/296,142

(22) PCT Filed: Mar. 20, 2002

(86) PCT No.: PCT/JP02/02731

§ 371 (c)(1),
(2), (4) Date: Nov. 20, 2002

(87) PCT Pub. No.: WO02/077308

PCT Pub. Date: Oct. 3, 2002

(65) Prior Publication Data

US 2003/0156968 A1 Aug. 21, 2003

(30) Foreign Application Priority Data

Mar. 23, 2001 (JP) ..... 2001-84706

(51) Int. Cl.[7] ..... C22C 21/02
(52) U.S. Cl. ..... 420/548; 420/551; 148/437
(58) Field of Search ..... 148/437; 420/548, 420/551

(56) References Cited

U.S. PATENT DOCUMENTS

| | | | |
|---|---|---|---|
| 4,818,308 A | 4/1989 | Odani et al. | |
| 5,387,272 A | 2/1995 | Kamitsuma et al. | |
| 5,466,277 A | 11/1995 | Miura et al. | |
| 6,132,532 A | 10/2000 | Shepelev et al. | |
| 6,332,906 B1 | 12/2001 | Haynes et al. | |
| 2002/0014406 A1 | 2/2002 | Takashima | |

FOREIGN PATENT DOCUMENTS

| | | | | |
|---|---|---|---|---|
| EP | 0503951 | | 9/1992 | |
| EP | 0508426 | | 10/1992 | |
| EP | 0529542 | | 3/1993 | |
| EP | 0535593 | | 4/1993 | |
| EP | 0558957 | | 9/1993 | |
| JP | 02061023 | | 3/1990 | |
| JP | 02061024 | | 3/1990 | |
| JP | 06116671 | | 4/1994 | |
| JP | 06116671 | A * | 4/1994 | ..... C22C/21/02 |
| JP | 06116672 | | 4/1994 | |
| JP | 8232034 | | 9/1996 | |
| JP | 11293374 | | 10/1999 | |
| JP | 11293374 | A * | 10/1999 | ..... C22C/21/02 |

* cited by examiner

*Primary Examiner*—George Wyszomierski
*Assistant Examiner*—Janelle Morillo
(74) *Attorney, Agent, or Firm*—W. F. Fasse; W. G. Fasse

(57) ABSTRACT

A heat-resistant, creep-resistant aluminum alloy according to the present invention contains at least 10 mass % and not more than 30 mass % of silicon, at least 3 mass % and not more than 10 mass % of at least either iron or nickel in total, at least 1 mass % and not more than 6 mass % of at least one rare earth element in total and at least 1 mass % and not more than 3 mass % of zirconium with the rest substantially consisting of aluminum, while the mean crystal grain size of silicon is not more than 2 μm, the mean grain size of compounds other than silicon is not more than 1 μm, and the mean crystal grain size of an aluminum matrix is at least 0.2 μm and not more than 2 μm. Thus, an aluminum alloy excellent in heat resistance and creep resistance is obtained.

8 Claims, 10 Drawing Sheets

PRESSURIZED POWDER COMPACT

PRESSURIZED POWDER COMPACT

DENSE FORGED BODY

CREEP DEFORMATION PROPERTIES

HEAT-RESISTANT, CREEP-RESISTANT ALUMINUM ALLOY AND BILLET THEREOF AS WELL AS METHODS OF PREPARING THE SAME

TECHNICAL OF THE INVENTION

The present invention relates to a heat-resistant, creep-resistant aluminum alloy and a billet thereof as well as methods of preparing the same, and more particularly, it relates to a heat-resistant, creep-resistant aluminum alloy suitable to a component employable at a temperature of at least 300° C. and required to have creep resistance and a billet thereof as well as methods of preparing the same.

BACKGROUND ART

Japanese Patent Laying-Open No. 11-293374 discloses an aluminum (Al) powder alloy having heat resistance and wear resistance. This gazette shows an aluminum alloy containing at least one of silicon (Si), titanium (Ti), iron (Fe) and nickel (Ni) and magnesium (Mg) as essential additional elements, with the mean crystal grain size of silicon and the mean grain sizes of other intermetallic compound phases not more than prescribed values.

Japanese Patent Laying-Open No. 8-232034 discloses an aluminum powder alloy having heat resistance and wear resistance with excellent deformability at a high temperature. This gazette mainly shows an aluminum alloy containing silicon, manganese (Mn), iron, copper (Cu) and magnesium. The gazette also shows a method of preparing an aluminum alloy by preforming rapidly solidified powder obtained by air atomization by powder pressurization molding and thereafter performing extrusion and hot swaging.

However, it has been proved that each of the aluminum alloys shown in the aforementioned two gazettes insufficiently satisfies performance for serving as a member required to have creep resistance, although the same is excellent in heat resistance and wear resistance.

SUMMARY OF THE INVENTION

An object of the present invention is to provide a heat-resistant, creep-resistant aluminum alloy excellent in heat resistance as well as in creep resistance and a billet thereof as well as methods of preparing the same.

The inventors have made deep study under the aforementioned object, to find out the composition and the structure of an aluminum alloy having both of sufficient heat resistance and sufficient creep resistance.

The heat-resistant, creep-resistant aluminum alloy according to the present invention consists of at least 10 mass % and not more than 30 mas % of silicon, at least 3 mass % and not more than 10 mass % of at least either iron or nickel in total, at least 1 mass % and not more than 6 mass % of at least one rare earth element in total and at least 1 mass % and not more than 3 mass % of zirconium (Zr) with the rest consisting of aluminu and unavoidable impurities, while the mean crystal grain size of silicon is not more than 2 μm, the mean grain size of compounds other than silicon is not more than 1 μm, arid the mean crystal grain size of an aluminum matrix is at least 0.2 μm and not more than 2 μm.

The heat-resistant, creep-resistant aluminum alloy according to the present invention consists of the aluminum alloy to which silicon, iron and/or nickel, a rare earth element and zirconium are added, and contains none of titanium, magnesium and copper dissimilarly to the conventional aluminum alloys. The aluminum alloy containing neither magnesium nor copper can be sufficiently increased in creep resistance. While titanium hinders refinement of crystal grains when added simultaneously with zirconium, the aluminum alloy according to the present invention containing no titanium is not hindered from refinement of crystal grains.

Thus, an aluminum alloy having microcrystal grains with excellent heat resistance and creep resistance can be obtained.

The content of silicon is set to at least 10 mass % and not more than 30 mass % since silicon crystallizes out in the alloy as silicon crystals to contribute to improvement of wear resistance, while the wear resistance is insufficiently improved if the silicon content is less than 10 mass % and the material is embrittled if the silicon content exceeds 30 mass %.

The content of at least either iron or nickel is set to at least 3 mass % and not more than 10 mass % in total on the basis of the following reason: Iron crystallizes a fine intermetallic compound of aluminum iron in the aluminum matrix to improve heat resistance of the matrix. When the aluminum alloy singly contains iron without nickel, no effect of improving heat resistance is attained if the iron content is less than 3 mass % while a large acicular intermetallic compound crystallizes out to embrittle the material if the iron content exceeds 10 mass %.

While iron may be singly added to the aluminum alloy, the intermetallic compound of aluminum and iron is Converted to a ternary intermetallic compound of aluminum, iron and nickel to be more refined when iron is compositely added along with nickel. The effect of improving heat resistance is reduced if the content of iron and/or nickel is less than 3 mass % in total, while the aluminum alloy is embrittled if the content of iron and/or nickel exceeds 10 mass % in total.

The content of at least one rare earth element is set to at least 1 mass % and not more than 6 mass % in total since the rare earth element has a function of improving tensile strength in the temperature range from the room temperature to a high temperature by reducing the size of an intermetallic compound of aluminum and a transition metal and refining silicon crystals. The aforementioned effect is small if the content of the rare earth element is less than 1 mass %, while the aforementioned effect is saturated if the content exceeds 6 mass %.

The content of zirconium is set to at least 1 mass % and not more than 3 mass % since it is effective to add zirconium improving heat resistance simultaneously with the aforementioned rare earth element while the aforementioned effect is small if the content of zirconium is less than 1 mass % and the aforementioned effect is saturated if the content exceeds 3 mass %.

The mean crystal grain size of silicon is set to not more than 2 μm since voids result in high strain rate superplastic deformation if the mean crystal grain size of silicon exceeds 2 μm.

The mean grain size of the compounds other than silicon is set to not more than 1 μm since high strain rate superplastic deformation is hard to attain if the mean grain size exceeds 1 μm.

The mean crystal grain size of the aluminum matrix is set to at least 0.2 μm and not more than 2 μm since grain boundary sliding is caused between crystal grains to develop superplasticity when stress is applied at a temperature of at least 450° C. in this grain size range. If the mean crystal grain size of the aluminum matrix is less than 0.2 μm, the strain rate developing superplasticity exceeds $10^2$/sec., to require a working method such as explosive forming extremely inferior in economy. If the mean crystal grain size of the aluminum matrix exceeds 2 μm, no superplasticity is developed or the strain rate is reduced below $10^{-2}$/sec. following development of superplasticity, to require a long time for hot working.

The aforementioned heat-resistant, creep-resistant aluminum alloy preferably contains at least 0.5 mass % and not more than 5 mass % of at least one element selected from a group consisting of cobalt (Co), chromium (Cr), manganese, molybdenum (No), tungsten (W) and vanadium CV) in total. These elements do not damage the heat-resistance and the creep-resistance of the aluminum alloy.

These elements, not damaging the heat resistance and the creep resistance of the aluminum alloy according to the present invention, can be added at need.

A billet of a heat-resistant, creep-resistant aluminum alloy according to the present invention contains at least 10 mass % and not more than 30 mass % of silicon, at least 3 mass % and not more than 10 mass % of at least either iron or nickel in total, at least 10 mass % and not more than 6 mass % of at least one rare earth element in total and at least 1 mass % and not more than 3 mass % of zirconium while containing none of titanium, magnesium and copper, with the rest substantially containing aluminum, and has a substantially cylindrical shape.

According to the inventive billet of a heat-resistant, creep-resistant aluminum alloy, an aluminum alloy having microcrystal grains with excellent heat resistance and creep resistance can be obtained.

In the aforementioned billet of a heat-resistant, creep-resistant aluminum alloy, elongation at 300° C. is preferably at least 1% and not more than 7%.

Such a billet having relatively small extension can be obtained by powder forging.

In the aforementioned billet of a heat-resistant, creep-resistant aluminum alloy, elongation at 300° C. is preferably at least 7% and not more than 15%.

Such a billet having relatively large extension can be obtained by powder forging.

A method of preparing a heat-resistant, creep-resistant aluminum alloy according to the present invention is a method of preparing a heat-resistant, creep-resistant aluminum alloy containing at least 10 mass % and not more than 30 mass % of silicon, at least 3 mass % and not more than 10 mass % of at least either iron or nickel in total, at least 1 mass % and not more than 6 mass % of at least one rare earth element in total and at least 1 mass % and not more than 3 mass % of zirconium with the rest Substantially consisting of aluminum, comprising a step of molding rapidly cooled alloy powder consisting of an aluminum alloy into a pressurized powder compact and thereafter working the pressurized powder compact into a product shape by hot plastic working, while the time exposing the pressurized powder compact not yet worked into the product shape to a temperature of at least 450° C. is at least 15 seconds and within 30 minutes.

According to the inventive method of preparing a heat-resistant, creep-resistant aluminum alloy, the composition of the aluminum alloy is specified by adding silicon, iron and/or nickel, a rare earth element and zirconium so that solidification can be performed while maintaining a microstructure also when the rate of temperature rise is not extremely high. Thus, high heat resistance and creep resistance can be implemented also when the pressurized powder compact not yet worked into the product shape is exposed to a temperature of at least 450° C. for at least 15 seconds and not more than 30 minutes.

While high heat resistance and creep resistance can be implemented also when the time exposing the pressurized powder compact to a temperature of at least 450° C. is less than 15 seconds, the equipment cost is increased in this case.

In the aforementioned method of preparing a heat-resistant, creep-resistant aluminum alloy, the pressurized powder compact is preferably solidified by hot plastic working at a rate of change (working rate) of at least 60% in average area of a section perpendicular to a pressurization axis for working the pressurized powder compact into the product shape.

Thus, a final product having a complicated shape can be readily manufactured.

In the aforementioned method of preparing a heat-resistant, creep-resistant aluminum alloy, the hot plastic working preferably includes a step of performing solidification by hot forging.

Thus, a final product can be manufactured with high forgeability.

In the aforementioned method of preparing a heat-resistant, creep-resistant aluminum alloy, the step of working the pressurized powder compact into the product shape by the hot plastic working preferably includes steps of performing first heat treatment on the pressurized powder compact at a temperature of at least 420° C. and not more than 550° C., performing powder forging on the pressurized powder compact subjected to the first heat treatment thereby obtaining a powder-forged body, performing second heat treatment on the powder-forged body at a temperature of at least 400° C. and not more than 550° C., and working the powder-forged body subjected to the second heat treatment into the product shape by shape forging.

Thus, an aluminum alloy excellent in heat resistance and heat creep resistance can be obtained through two heating steps and two forging steps.

In the aforementioned method of preparing a heat-resistant, creep-resistant aluminum alloy, the step of working the pressurized powder compact into the product shape by the hot plastic working preferably includes steps of performing heat treatment on the pressurized powder compact at a temperature of at least 450° C. and not more than 550° C., performing powder forging on the pressurized powder compact subjected to the heat treatment thereby obtaining a powder-forged body, and working the powder-forged body into the product shape by shape forging.

Thus, an aluminum alloy having microcrystal grains with excellent heat resistance and creep resistance can be obtained through a single heating step and two forging steps.

In the aforementioned method of preparing a heat-resistant, creep-resistant aluminum alloy, the step of working the pressurized powder compact into the product shape by the hot plastic working preferably further includes steps of performing heat treatment on the pressurized powder compact at a temperature of at least 450° C. and not more than 550° C., and working the pressurized powder compact subjected to the heat treatment into the product shape by powder shape forging.

Thus, an aluminum alloy having microcrystal grains with excellent heat resistance and creep resistance can be obtained through a single heating step and a single forging step.

In the aforementioned method of preparing a heat-resistant, creep-resistant aluminum alloy, the step of working the pressurized powder compact into the product shape by the hot plastic working preferably includes steps of performing first heat treatment on the pressurized powder compact at a temperature of at least 420° C. and not more than 550° C., performing extrusion on the pressurized powder compact subjected to the first heat treatment thereby obtaining an extruded body, cutting the extruded body, performing second heat treatment on the cut extruded body at a temperature of at least 400° C. and not more than 550° C., and working the extruded body subjected to the second heat treatment into the product shape by shape forging.

Thus, an aluminum alloy having microcrystal grains with excellent heat resistance and creep resistance can be obtained by heating and extrusion.

A method of preparing a billet of a heat-resistant, creep-resistant aluminum alloy according to the present invention is a method of preparing a billet of a heat-resistant, creep-resistant aluminum alloy containing at least 10 mass % and not more than 30 mass % of silicon, at least 3 mass % and not more than 10 mass 10 of at least either iron or nickel in total, at least 1 mass % and not more than 6 mass % of at least one rare earth element in total and at least 1 mass % and not more than 3 mass % of zirconium while containing none of titanium, magnesium and copper, with the rest substantially containing aluminum, comprising a step of molding rapidly cooled alloy powder consisting of an aluminum alloy into a pressurized powder compact and thereafter performing hot plastic working on the pressurized powder compact thereby forming a billet, while the time exposing the pressurized powder compact to a temperature of at least 450° C. before forming the billet is at least 10 seconds and within 20 minutes.

According to the inventive method of preparing a billet of a heat-resistant, creep-resistant aluminum alloy, an aluminum alloy having a microcrystal grains with excellent heat resistance and creep resistance can be obtained.

BRIEF DESCRIPTION OF THE DRAWINGS

FIG. 12B is a schematic sectional view taken along the line XII—XII in FIG. 12A, and FIG. 13B is a schematic sectional view taken along the line XIII—XIII in FIG. 13A.

BEST MODES FOR CARRYING OUT THE INVENTION

Figure 1:
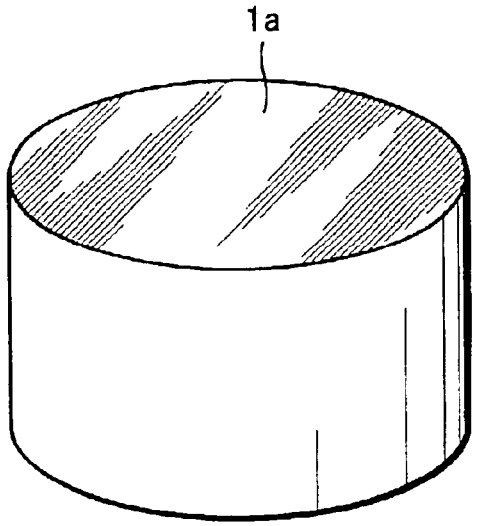
FIGS. 1 to 3 are schematic perspective views showing first hot plastic working of a heat-resistant, creep-resistant aluminum alloy according to an embodiment of the present invention in order of steps.

An embodiment of the present invention is now described with reference to the drawings.

A heat-resistant, creep-resistant aluminum alloy according to the present invention contains at least 10 mass % and not more than 30 mass % of silicon, at least 3 mass % and not more than 10 mass % of at least either iron or nickel in total, at least 1 mass % and not more than 6 mass % of at least one rare earth element (e.g., misch metal (MM)) in total and at least 1 mass % and not more than 3 mass % of zirconium with the rest consisting of aluminum and unavoidable impurities, and substantially contains no other additional elements. In the aluminum alloy, the mean crystal grain size of silicon is not more than 2 $\mu$m, the mean grain size of compounds other than silicon is not more than 1 $\mu$m, and the mean crystal grain size of the aluminum matrix is at least 0.2 $\mu$m and not more size of the aluminum matrix is at learnt 0.2 $\mu$m and not more than 2 $\mu$m. Particularly titanium, magnesium and copper are avoided since these elements have a bad influence on the creep resistance and on the refinement of the crystal grains.

The aforementioned aluminum alloy, substantially containing no elements other than the aforementioned additional elements, may contain other elements in a range not damaging heat resistance and creep resistance. For example, the aluminum alloy may contain at least 0.5 mass % and not more than 5 mass % of at least one element selected from a group consisting of cobalt, chromium, manganese, molybdenum, tungsten and vanadium in total as other element(s). The aluminum alloy according to this embodiment contains none of titanium, magnesium and copper exerting bad influence on creep resistance and refinement of crystal grains.

A preparation method according to this embodiment is now described.

The preparation method according to this embodiment is a method of preparing a heat-resistant, creep-resistant aluminum alloy having the aforementioned composition.

In the method of preparing the heat-resistant, creep-resistant aluminum alloy having such a composition, rapidly cooled alloy powder consisting of an aluminum alloy is first formed by atomization or the like, for example. This rapidly cooled alloy powder is molded into a pressurized powder compact, which in turn is worked into a product shape by hot plastic working.

The steps of the hot plastic working are described with reference to FIGS. 1 to 3.

Referring to FIG. 1, rapidly cooled alloy powder is molded to form a cylindrical pressurized powder compact 1*a*, for example. The relative density of this pressurized powder compact 1*a* is about 80%, for example.

Figure 2:
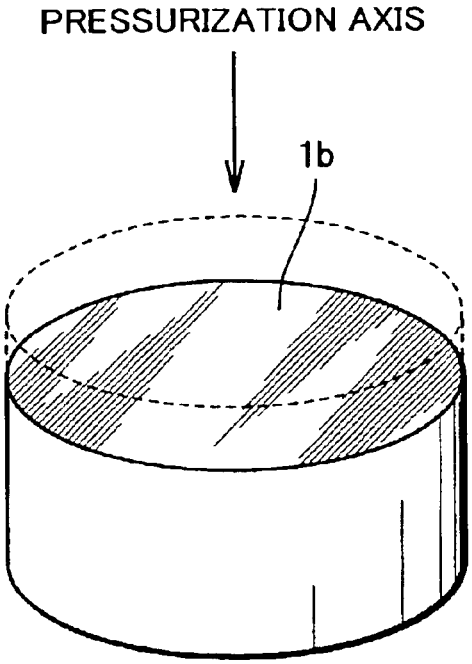

Referring to FIG. 2, this pressurized powder compact 1*a* is heated and thereafter pressurized by hot forging (powder forging), for example, thereby forming a dense forged body (billet) 1*b*. The relative density of this dense forged body 1*b* is 100%.

Figure 3:
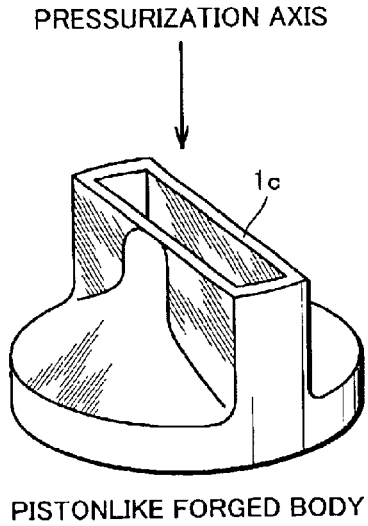

Referring to FIG. 3, this dense forged body 1*b* is heated and thereafter pressurized by hot forging (shape forging), for example, thereby forming a pistonlike forged body (product) 1*c,* for example, having the final product shape.

In the above description, powder forging is a step of removing moisture adsorbed by the pressurized powder compact 1*a* and increasing the relative density to 100%, thereby obtaining the billet. In the above description, further, shape forging is a step for working the billet into the final product shape.

The time exposing the pressurized powder compact to a temperature of at least 450° in the process for working the same into the final product shape is at least 15 seconds and within 30 minutes.

Further, solidification is preferably performed by hot plastic working (e.g., hot forging) with a working rate (rate of change of the average area of a section perpendicular to the pressurization axis) of at least 60% for working the pressurized powder compact 1*a* into the forged body 1*c* having the final product shape.

The hot plastic working preferably includes a step of performing solidification by a single or at least two steps of hot forging as hereinabove described.

Another exemplary hot plastic working including extrusion is described with reference to FIGS. 4A, 4B and 5.

In this method, rapidly cooled alloy powder is first molded for forming a cylindrical pressurized powder compact 1*a,* for example, as shown in FIG. 1. The relative density of this pressurized powder compact 1*a* is about 80%, for example.

Figure 4A:
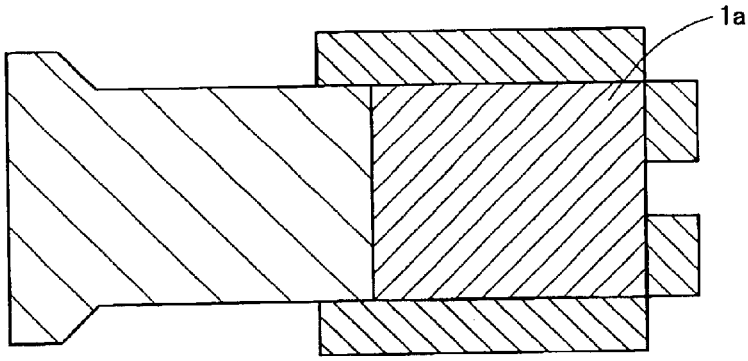
FIGS. 4A, 4B and 5 are schematic perspective views showing second hot plastic working of the heat-resistant, creep-resistant aluminum alloy according to the embodiment of the present invention in order of steps.
Figure 4B:
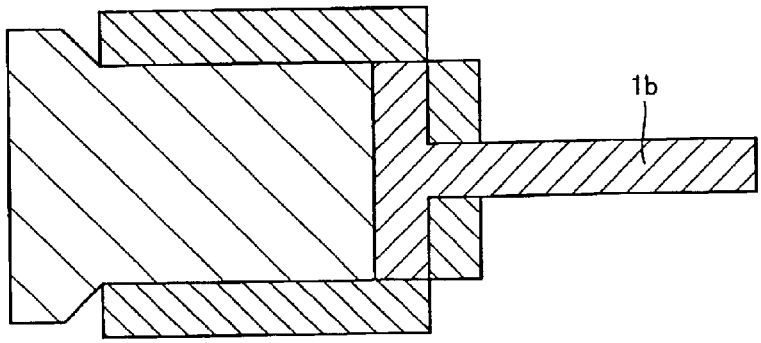

Referring to FIGS. 4A and 4B, this pressurized powder compact 1*a* is heated and thereafter worked by powder extrusion, for example, thereby forming an extruded body 1*b*. The relative density of this extruded body 1*b* is 100%. This extruded body 1*b* is cut.

Figure 5:
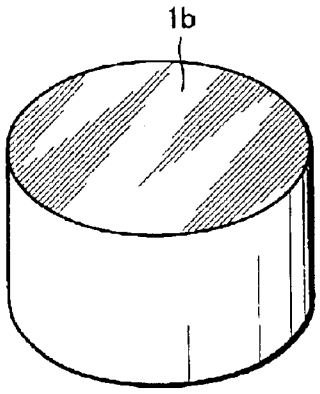

Referring to FIG. 5, the extruded body 1*b* is cut thereby forming a billet 1*b*. This billet 1*b* is heated and thereafter pressurized by hot forging (shape forging), for example, thereby forming a pistonlike forged body (product) 1*c,* for example, having the final product shape shown in FIG. 3.

Thus, the billet may be formed not by powder forging but by powder extrusion, to be thereafter worked into the final product shape by shape forging.

These preparation methods are now described in detail as to four patterns.

Figure 6:
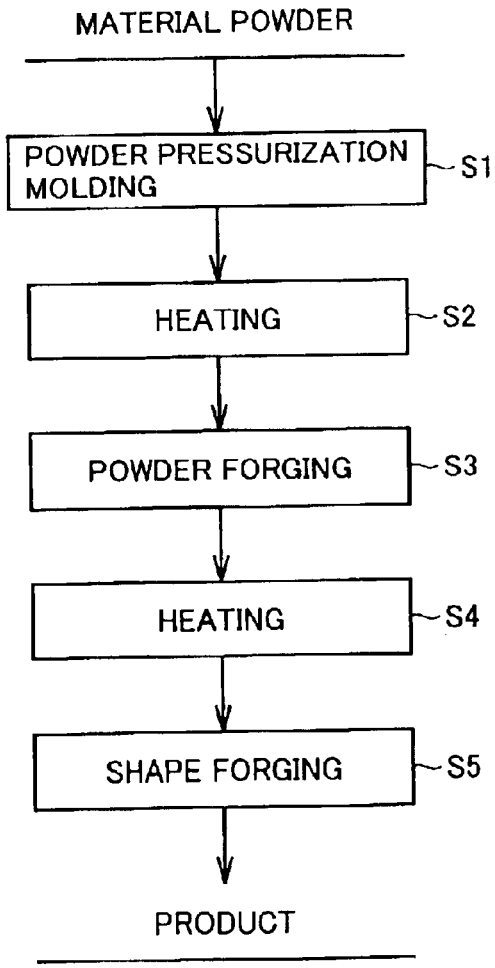
FIG. 6 illustrates a first method of preparing the heat-resistant, creep-resistant aluminum alloy according to the embodiment of the present invention.

Referring to FIG. 6, material powder consisting of rapidly cooled alloy powder having a prescribed composition is first prepared in the first preparation method. This material powder is subjected to powder pressurization molding (step S1), thereby forming the cylindrical pressurized powder compact 1*a* shown in FIG. 1. The relative density of this pressurized powder compact 1*a* is set to 80%. This pressurized powder compact 1*a* is heated at a temperature of at least 420° C. and not more than 550° C. At this time, the pressurized powder compact 1*a* is heated at a temperature of at least 460° C. and not more than 500° C. for at least 15 seconds and within 15 minutes, under more preferable conditions (step S2). The heated pressurized powder compact 1*a* is subjected to hot forging (powder forging) (step S3). In this powder forging, the pressurized powder compact 1*a* is so worked that the relative density reaches 100% and the area of a section of the pressurized powder compact 1*a* perpendicular to a compression axis remains unchanged. Thus, the dense forged body (billet) 1*b* shown in FIG. 2 is obtained. This billet 1*b* is heated at a temperature of at least 400° C. and not more than 550° C. At this time, the billet 1*b* is heated at a temperature of at least 400° C. and not more than 500° C. for at least 15 seconds and within 15 minutes under more preferable conditions (step S4). The heated billet 1*b* is subjected to hot forging (shape forging) (step S5). In this shape forging, the billet 1*b* is worked into the final product shape so that the area of the section of the billet 1*b* perpendicular to the compression axis changes within the range of at least 60% and not more than 90%. Thus, the pistonlike forged body (product) 1*c,* for example, having the final product shape shown in FIG. 3 is formed.

Figure 7:
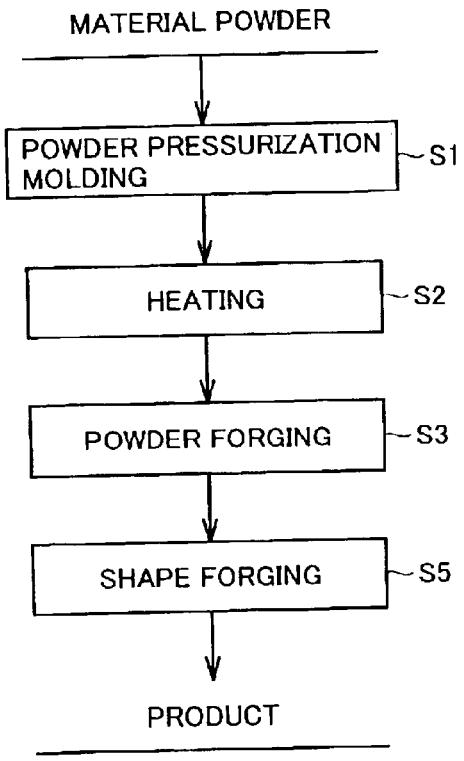
FIG. 7 illustrates a second method of preparing the heat-resistant, creep-resistant aluminum alloy according to the embodiment of the present invention.

Referring to FIG. 7, material powder consisting of rapidly cooled alloy powder having a prescribed composition is first prepared in the second preparation method. This material powder is subjected to powder pressurization molding (step S1), thereby forming the cylindrical pressurized powder compact 1*a* shown in FIG. 1. The relative density of this pressurized powder compact 1*a* is set to 80%. This pressurized powder compact 1*a* is heated at a temperature of at least 450° C. and not more than 550° C. At this time, the pressurized powder compact 1*a* is heated at a temperature of at least 460° C. and not more than 520° C. for at least 15 seconds and within 30 minutes, under more preferable conditions (step S2). The heated pressurized powder compact 1*a* is subjected to hot forging (powder forging) (step S3). In this powder forging, the pressurized powder compact 1*a* is so worked that the relative density reaches 100% and the area of a section of the pressurized powder compact 1*a* perpendicular to a compression axis remains unchanged. Thus, the dense forged body (billet) 1*b* shown in FIG. 2 is obtained. This billet 1*b* is subjected to hot forging (shape forging) (step S5). In this shape forging, the billet 1*b* is worked into the final product shape so that the area of the section of the billet 1*b* perpendicular to the compression axis changes within the range of at least 60% and not more than 90%. Thus, the pistonlike forged body (product) 1*c,* for example, having the final product shape shown in FIG. 3 is formed.

Figure 8:
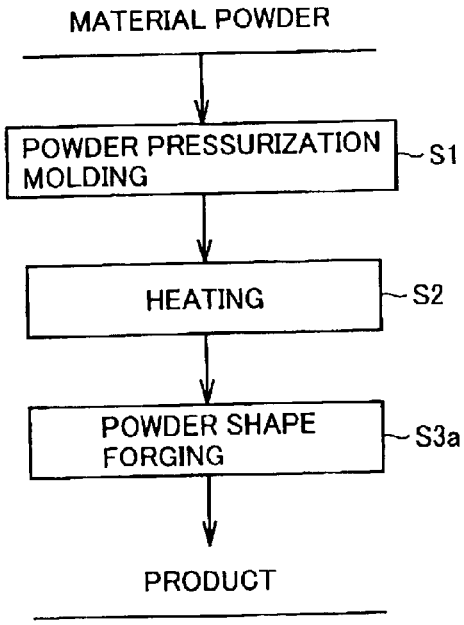
FIG. 8 illustrates a third method of preparing the heat-resistant, creep-resistant aluminum alloy according to the embodiment of the present invention.

Referring to FIG. 8, material powder consisting of rapidly cooled alloy powder having a prescribed composition is first prepared in the third preparation method. This material powder is subjected to powder pressurization molding (step S1), thereby forming the cylindrical pressurized powder compact 1*a* shown in FIG. 1. The relative density of this pressurized powder compact 1*a* is set to 80%. This pressurized powder compact 1*a* is heated at a temperature of at least 450° C. and not more than 550° C. At this time, the pressurized powder compact 1*a* is heated at a temperature of at least 460° C. and not more than 520° C. for at least 15 seconds and within 30 minutes, under more preferable conditions (step S2). The heated pressurized powder compact 1*a* is subjected to hot forging (powder shape forging) (step S3*a*). In this powder shape forging, the pressurized powder compact 1*a* is so worked into the final product shape that the relative density reaches 100% and the area of a section of the billet 1*b* perpendicular to a compression axis changes within the range of at least 60% and not more than 90%. Thus, the pistonlike forged body (product) 1*c,* for example, having the final product shape shown in FIG. 3 is formed.

Figure 9:
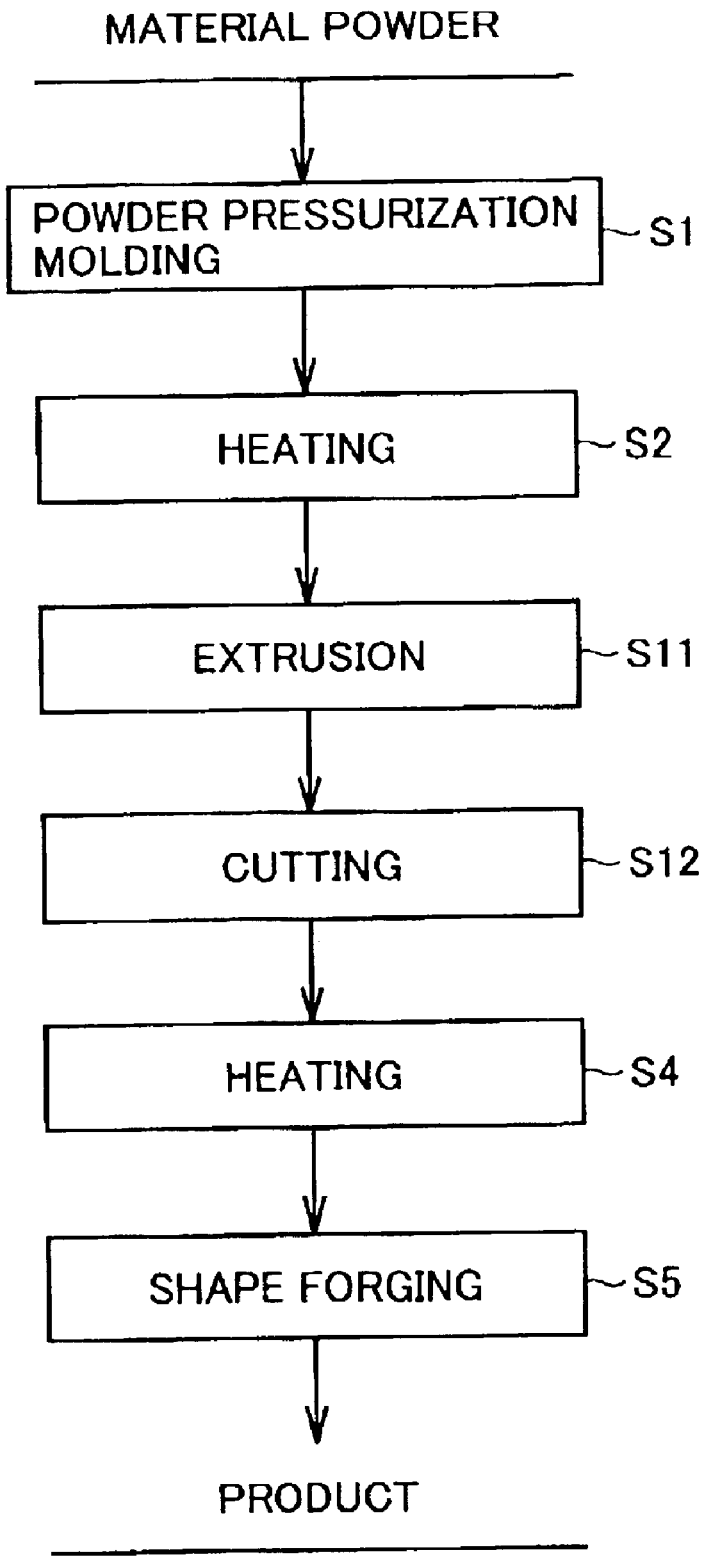
FIG. 9 illustrates a fourth method of preparing the heat-resistant, creep-resistant aluminum alloy according to the embodiment of the present invention.

Referring to FIG. 9, material powder consisting of rapidly cooled alloy powder having a prescribed composition is first prepared in the fourth preparation method. This material powder is subjected to powder pressurization molding (step S1), thereby forming the cylindrical pressurized powder compact 1*a* shown in FIG. 1. The relative density of this pressurized powder compact 1*a* is set to 80%. This pressurized powder compact 1*a* is heated at a temperature of at least 420° C. and not more than 550° C. At this time, the pressurized powder compact 1*a* is heated at a temperature of at least 450° C. and not more than 500° C. for at least 15 seconds and within 15 minutes, under more preferable conditions (step S2). The heated pressurized powder compact 1*a* is subjected to extrusion as shown in FIGS. 4A and 4B (step S11). In this extrusion, the pressurized powder compact 1*a* is so worked that the relative density reaches 100% and the area of a section of the pressurized powder compact 1*a* perpendicular to a compression axis changes within the range of at least 75% and not more than 90%. Thereafter the extruded body 1*b* is cut (step S12), thereby obtaining the billet 1*b* shown in FIG. 5. This billet 1*b* is heated at a temperature of at least 400° C. and not more than 550° C. At this time, the billet 1*b* is heated at a temperature of at least 400° C. and not more than 500° C. for at least 15 seconds and within 15 minutes, under more preferable conditions (step S4). The heated billet 1*b* is subjected to hot forging (shape forging) (step S5). In this shape forging, the billet 1*b* is worked into the final product shape so that the area of the section of the billet 1*b* perpendicular to the compression axis changes within the range of at least 60% and not more than 90%. Thus, the pistonlike forged body (product) 1*c*, for example, having the final product shape shown in FIG. 3 is formed.

The billet obtained according to this embodiment is now described.

Figure 10:
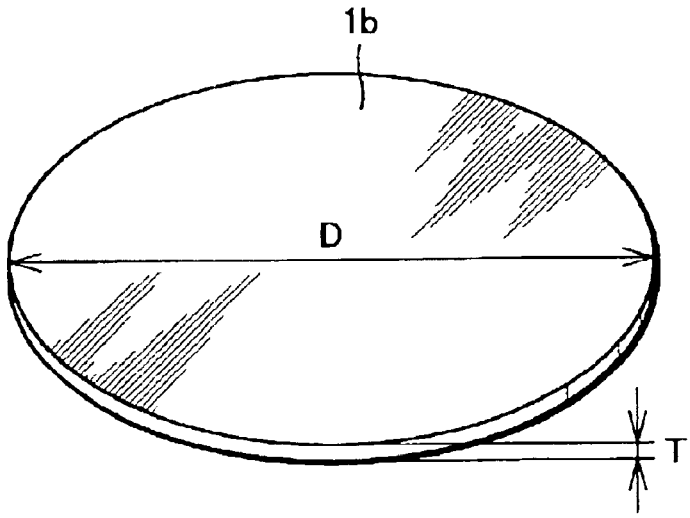
FIGS. 10, 11, 12A, 12B, 13A and 13B are perspective views for illustrating the shape of a billet for preparing the heat-resistant, creep-resistant aluminum alloy according to the embodiment of the present invention.
Figure 11:
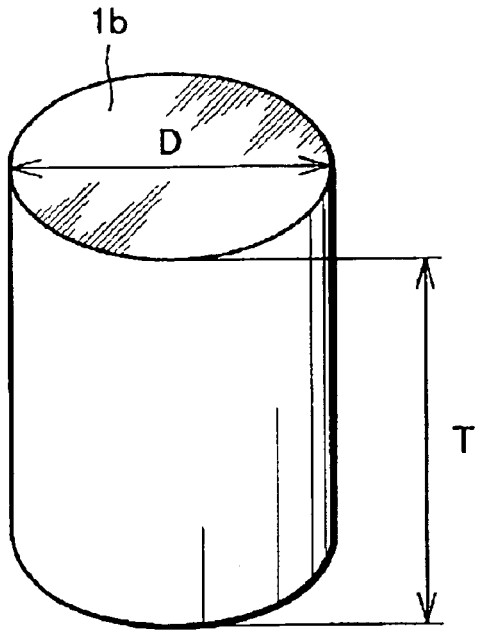
Figure 12A:
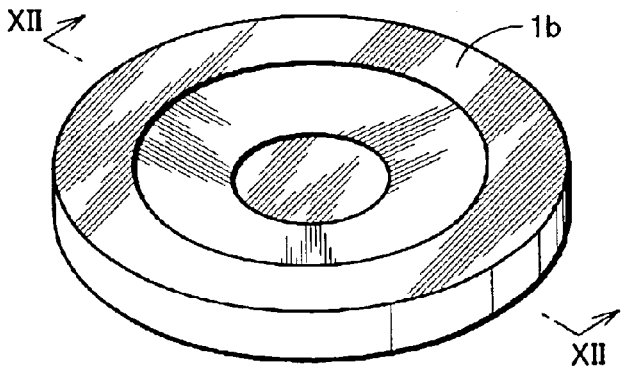
Figure 12B:
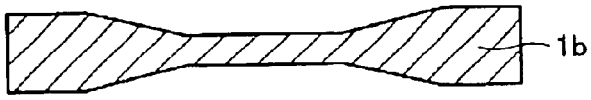
Figure 13A:
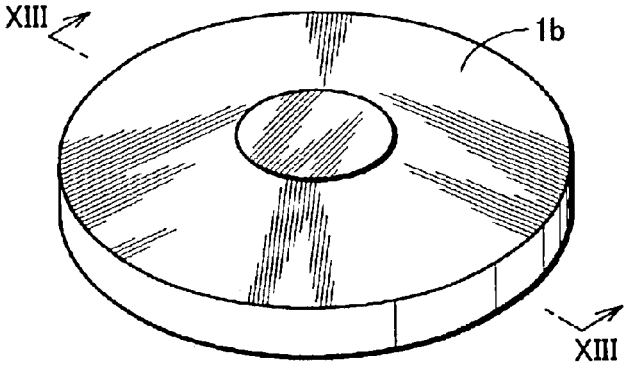
Figure 13B:
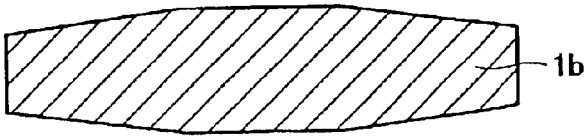

In any of the aforementioned first to fourth preparation methods, the cylindrical billet 1*b* shown in FIG. 2 or FIG. 5 is obtained. The cylindrical shape includes not only a discoidal shape having a small thickness (length) T with respect to the diameter D as shown in FIG. 10 but also a columnar shape having a large thickness (length) T with respect to the diameter D as shown in FIG. 11. It is assumed that the cylindrical shape in the present invention also includes shapes, not completely cylindrical, having small dents on the front and rear surfaces as shown in FIGS. 12A and 12B and having small projections on the front and rear surfaces as shown in FIGS. 13A and 13B, for example.

The billet of a heat-resistant, creep-resistant aluminum alloy according to this embodiment has the composition containing at least 10 mass % and not more than 30 mass % of silicon, at least 3 mass % and not more than 10 mass % of either iron or nickel in total, at least 1 mass % and not more than 6 mass % of at least one rare earth element (e.g., misch metal (MM)) in total and at least 1 mass % and not more than 3 mass % of zirconium while containing none of titanium, magnesium and copper, with the rest consisting of aluminum and unavoidable impurities.

This billet 1*b* may contain other elements in a range not damaging heat resistance and creep resistance. For example, the billet may contain at least 0.5 mass % and not more than 5 mass % of at least one element selected from a group consisting of cobalt, chromium, manganese, molybdenum, tungsten and vanadium in total as other element(s).

The powder-forged billet 1*b* prepared according to the first or second preparation method has tensile strength of at least 230 MPa and not more than 260 MPa at 300° C., elongation of at least 1% and not more than 7% at 300° C., and hardness of at least 77 and not more than 92 in HRB (B scale of Rockwell hardness) at the room temperature. The grain size of Si in the structure of this powder-forged billet 1*b* is at least 1.0 μm and not more than 1.6 μm, the grain sizes of compounds other than Si are at least 0.5 μm and not more than 0.7 μm, and the grain size of Al is at least 0.3 μm and not more than 0.5 μm.

The extruded/cut billet 1*b* prepared according to the fourth preparation method has tensile strength of at least 220 MPa and not more than 250 MPa at 300° C., elongation of at least 7% and not more than 15% at 300° C., and hardness of at least 74 and not more than 88 in HRB at the room temperature. The grain size of Si in the structure of this extruded/cut billet 1*b* is at least 1.1 μm and not more than 1.7 μm, the grain sizes of compounds other than Si are at least 0.6 μm and not more than 0.8 μm, and the grain size of Al is at least 0.4 μm and not more than 0.6 μm.

The product 1*c* having the final shape shown in FIG. 3 has tensile strength of at least 215 MPa and not more than 247 MPa at 300° C., elongation of at least 9% and not more than 14% at 300° C., and hardness of at least HRB 72 and not more than HRB 88 at the room temperature. The grain size of Si in the structure of this product 1*c* having the final shape is at least 1.1 μm and not more than 1.7 μm, the grain sizes of compounds other than Si are at least 0.6 μm and not more than 0.8 μm, and the grain size of Al is at least 0.4 μm and not more than 0.6 μm.

Experimental Example of the present invention is now described.

Rapidly cooled alloy powder materials having compositions of samples Nos. 1 to 44 shown in Table 1 were prepared by air atomization and molded to prepare pressurized powder compacts of ϕ80×21 mm. Piston like forged bodies having final shapes were prepared from the pressurized powder compacts by combinations of the following heating patterns A to E and hot plastic working a to e.

Referring to Table 1, misch metal (MM) was composed of 25 mass % of lanthanum (La), 50 mass % of cerium (Ce), 5 mass % of praseodymium (Pr) and 20 mass % of neodymium (Nd).

TABLE 1

| | Sample | Composition (Mass %) | | | | | | | | | | | | | Heating | Hot Plastic |
|---|---|---|---|---|---|---|---|---|---|---|---|---|---|---|---|---|
| | No. | Si | Fe | Ni | Zr | MM | Cu | Mg | Cr | Mn | Mo | Co | W | V | Pattern | Working |
| Inventive Sample | 1 | 11 | 5 | 3 | 1.2 | 5 | | | | | | | | | A | a |
| | 2 | 11 | 2 | 4 | 2.5 | 4 | | | | | | | | | A | a |
| | 3 | 14 | 5 | 2 | 1.2 | 5 | | | | | | | | | A | a |
| | 4 | 14 | 2 | 3 | 2 | 4 | | | | | | | | | A | a |
| | 5 | 17 | 4 | | 1.5 | 5 | | | | | | | | | A | a |
| | 6 | 17 | 3 | 0.5 | 1.5 | 5 | | | | | | | | | A | a |
| | 7 | 17 | 2 | 1.5 | 1.5 | 5.5 | | | | | | | | | A | a |
| | 8 | 17 | 1 | 2 | 1.2 | 5.5 | | | | | | | | | A | a |
| | 9 | 17 | | 3 | 1.5 | 5 | | | | | | | | | A | a |
| | 10 | 20 | 4 | | 1.5 | 4 | | | | | | | | | A | a |

TABLE 1-continued

| | Sample | Composition (Mass %) | | | | | | | | | | | | | Heating | Hot Plastic |
|---|---|---|---|---|---|---|---|---|---|---|---|---|---|---|---|---|
| | No. | Si | Fe | Ni | Zr | MM | Cu | Mg | Cr | Mn | Mo | Co | W | V | Pattern | Working |
| | 11 | 20 | 3 | 0.5 | 1.5 | 4 | | | | | | | | | A | a |
| | 12 | 20 | 2 | 1.5 | 1.2 | 5 | | | | | | | | | A | a |
| | 13 | 20 | 1 | 2 | 1.2 | 5.5 | | | | | | | | | A | a |
| | 14 | 20 | | 3 | 1.2 | 5 | | | | | | | | | A | a |
| | 15 | 25 | 3 | 0.5 | 1.5 | 2 | | | | | | | | | A | a |
| | 16 | 25 | 2 | 1.5 | 1.2 | 5 | | | | | | | | | A | a |
| | 17 | 25 | 1 | 2 | 1.2 | 5 | | | | | | | | | A | a |
| | 18 | 25 | | 3 | 1.2 | 3 | | | | | | | | | A | a |
| | 19 | 17 | 2 | 1.5 | 1.5 | 5 | | | 0.1 | 0.3 | | | | | A | a |
| | 20 | 17 | 2 | 1.5 | 1.5 | 5 | | | 0.5 | | 0.3 | | | | A | a |
| | 21 | 20 | 2 | 1.5 | 1.2 | 5 | | | | | | 0.8 | | | A | a |
| | 22 | 20 | 2 | 1.5 | 1.2 | 5 | | | | | | | 0.2 | 0.6 | A | a |
| | 23 | 20 | 2 | 1.5 | 1.2 | 5 | | | | | | | | | B | a |
| | 24 | 20 | 2 | 1.5 | 1.2 | 5 | | | | | | | | | C | a |
| | 25 | 17 | 2 | 1.5 | 1.5 | 5 | | | | | | | | | A | b |
| | 26 | 17 | 2 | 1.5 | 1.5 | 5 | | | | | | | | | A | c |
| | 27 | 17 | 2 | 1.5 | 1.5 | 5 | | | | | | | | | A | d |
| | 28 | 17 | 2 | 1.5 | 1.5 | 5 | | | | | | | | | A | e |
| | 29 | 20 | 2 | 1.5 | 1.2 | 5 | | | | | | | | | D | a |
| Comparative | 30 | 20 | 2 | 1.5 | 1.2 | 5 | | | | | | | | | E | a |
| Sample | 31 | 17 | 2 | 1.5 | 1.5 | 5 | 1 | | | | | | | | A | a |
| | 32 | 17 | 2 | 1.5 | 1.5 | 5 | | 0.8 | | | | | | | A | a |
| | 33 | 17 | 1 | 2 | 1.2 | 5 | 0.5 | 0.06 | | | | | | | A | a |
| | 34 | 17 | 1 | 2 | 1.2 | 5 | | 0.1 | | | | | | | A | a |
| | 35 | 8 | 8 | | 1.5 | 5 | | | | | | | | | A | a |
| | 36 | 32 | 4 | 2 | 1.2 | 3 | | | | | | | | | A | a |
| | 37 | 11 | 12 | | 1.2 | 5 | | | | | | | | | A | a |
| | 38 | 20 | 0.5 | 0.5 | 1.5 | 5 | | | | | | | | | A | a |
| | 39 | 20 | 3 | 2 | 0 | 5 | | | | | | | | | A | a |
| | 40 | 17 | 2 | 1.5 | 1.5 | 0.7 | | | | | | | | | A | a |
| | 41 | 17 | 2 | 0 | 0 | 2 | 4 | 0.5 | | | | | | | A | a |
| | 42 | 17 | 2 | 0 | 0 | 8 | 4 | 0.5 | | | | | | | A | a |
| | 43 | 12 | 5 | 3 | 2 | | | | | | | | | | A | a |
| | 44 | 17 | 5 | | 1 | | | | | 3 | | | | | A | a |

(Composition of MM: La: 25 mass %, Ce: 50 mass %, Pr: 5 mass %, Nb: 20 mass %)

Figure 14:
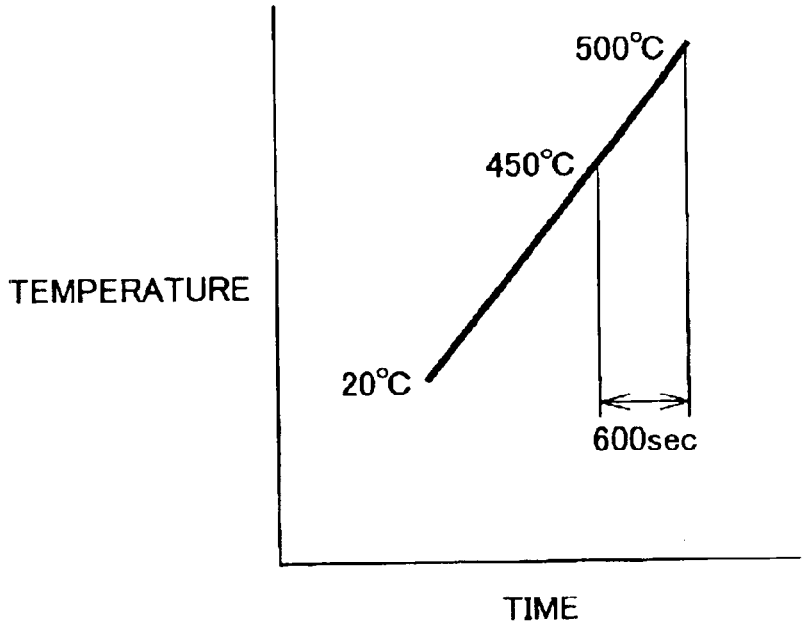
FIGS. 14 to 18 illustrate heating patterns A to E respectively.
Figure 15:
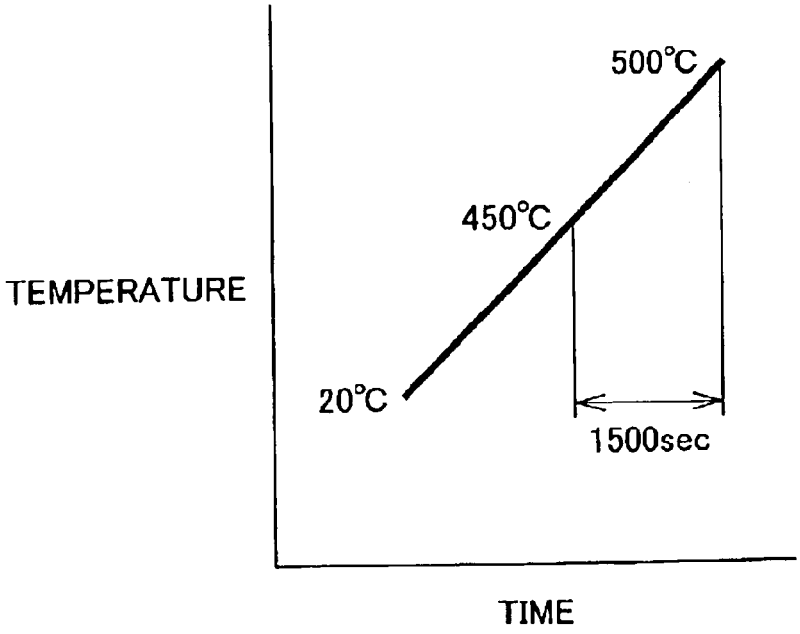
Figure 16:
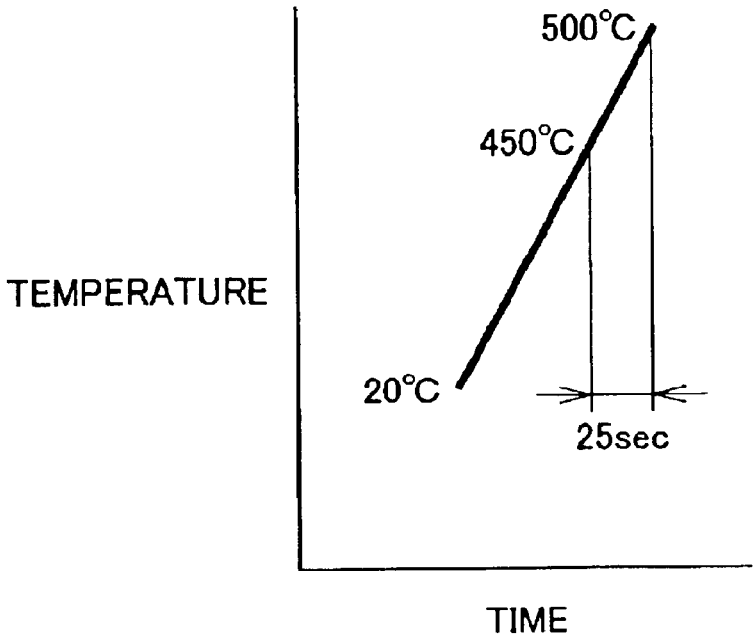
Figure 17:
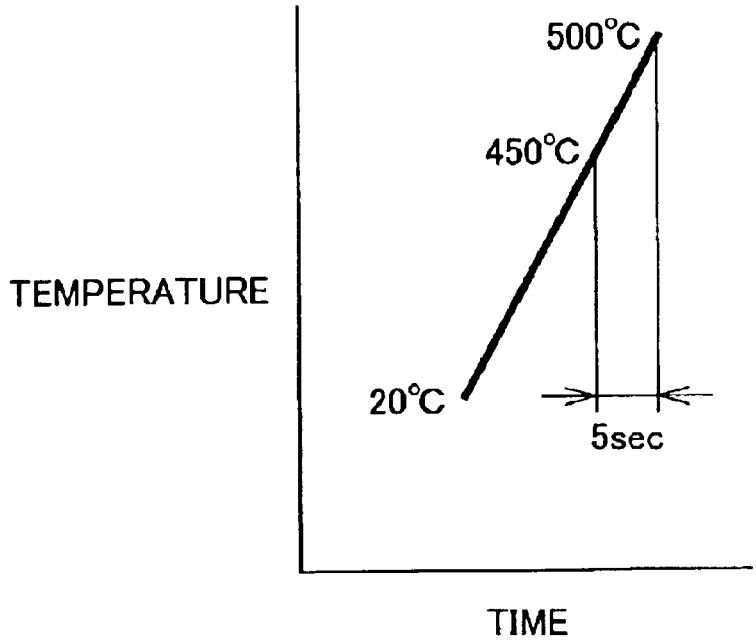
Figure 18:
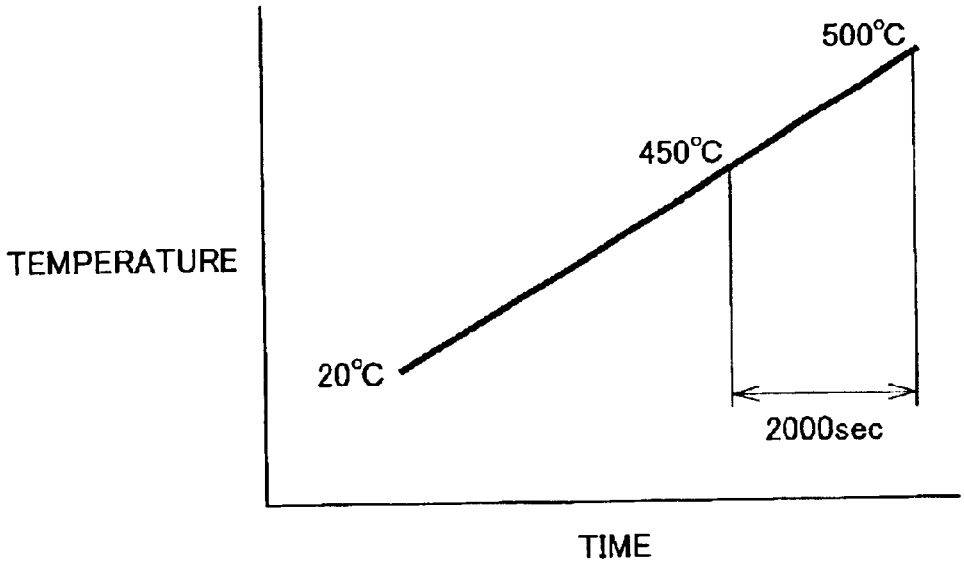
Figure 19:
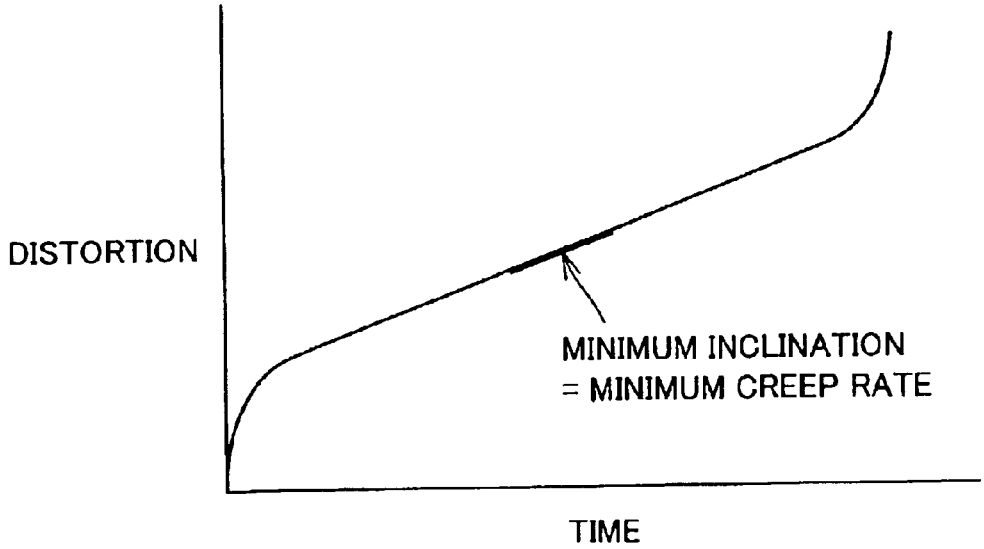
FIG. 19 illustrates creep deformation properties.

The aforementioned heating patterns A to E were set as follows:

The times for heating the samples from 450° C. to 500° C. were set to 600 seconds in the heating pattern A as show in FIG. 14, to 1500 seconds in the heating pattern B as shown in FIG. 15, to 25 seconds in the heating pattern C as shown in FIG. 16, to 5 seconds in the heating pattern D as shown in FIG. 17, and to 2000 seconds in the heating pattern E as shown in FIG. 18.

The rates for heating the samples from 20° C. to 450° C. in the respective heating patterns A to E were set identical to the rates for heating the samples from 450° C. to 500° C. in the respective heating patterns.

In the hot plastic working a, the pressurized powder compact 1*a* of ϕ80×21 mm shown in FIG. 1 was worked into the dense forged body 1*b* of ϕ80×16 mm shown in FIG. 2 by hot forging, and this dense forged body 1*b* was further worked into the pistonlike forged body 1*c* of ϕ80 mm shown in FIG. 3 by hot forging. The working rate in this pistonlike forged body 1*c* was set to 67%.

In the hot plastic working b, the pressurized powder compact 1*a* of ϕ80×21 mm shown in FIG. 1 was worked into the pistonlike forged body 1*c* of ϕ80 mm shown in FIG. 3 by hot forging. The working rate in this pistonlike forged body 1*c* was set to 67%.

In the hot plastic working c, the pressurized powder compact 1*a* of ϕ80×21 mm shown in FIG. 1 was worked into the dense forged body 1*b* of ϕ80×16 mm shown in FIG. 2 by hot forging, and this dense forged body 1*b* was further worked into the pistonlike forged body 1*c* of ϕ80 mm shown in FIG. 3 by hot forging. The working rate in this pistonlike forged body 1*c* was set to 75%.

In the hot plastic working d, the pressurized powder compact 1*a* of ϕ80×21 mm shown in FIG. 1 was worked into the dense forged body 1*b* of ϕ80×16 mm shown in FIG. 2 by hot forging, and this dense forged body 1*b* was further worked into the pistonlike forged body 1*c* of ϕ80 mm shown in FIG. 3 by hot forging. The working rate in this pistonlike forged body 1*c* was set to 50%.

In the hot plastic working e, the pressurized powder compact 1*a* of ϕ80×21 mm shown in FIG. 1 was worked into the pistonlike forged body 1*c* of ϕ80 mm shown in FIG. 3 by hot forging. The working rate in this pistonlike forged body 1*c* was set to 50%.

As to the forged bodies having the final shapes obtained in the aforementioned manner, tensile strength values at 300° C., elongation values at 300° C. and minimum creep rates following application of tension of 80 MPa at 300° C. were measured. As to the forged bodies having the final shapes obtained in the aforementioned manner, further, mean crystal grain sizes of silicon, mean grain sizes of compounds other than silicon and mean crystal grain sizes of aluminum matrices were measured. Tables 2 and 3 show the results.

TABLE 2

| Sample No. | Evaluated Items: 300° C. Tensile Strength (MPa) | 300° C. Elongation (%) | 300° C. 80 MPa Minimum Creep Rate (l/s) | Si Grain Size (μm) | Grain Size of Compound Other than Si (μm) | Al Grain Size (μm) |
|---|---|---|---|---|---|---|
| Inventive Sample | | | | | | |
| 1 | 220 | 12.2 | $7.70 \times 10^{-9}$ | 1.2 | 0.8 | 0.6 |
| 2 | 215 | 13.5 | $8.50 \times 10^{-9}$ | 1.1 | 0.8 | 0.6 |
| 3 | 227 | 12.6 | $6.00 \times 10^{-9}$ | 1.3 | 0.8 | 0.6 |
| 4 | 225 | 12 | $5.60 \times 10^{-9}$ | 1.3 | 0.8 | 0.6 |
| 5 | 216 | 11.4 | $3.80 \times 10^{-9}$ | 1.4 | 0.7 | 0.6 |
| 6 | 228 | 12.2 | $4.20 \times 10^{-9}$ | 1.3 | 0.8 | 0.5 |
| 7 | 224 | 11.6 | $4.00 \times 10^{-9}$ | 1.5 | 0.7 | 0.6 |
| 8 | 220 | 12 | $4.40 \times 10^{-9}$ | 1.5 | 0.7 | 0.5 |
| 9 | 232 | 10.8 | $3.70 \times 10^{-9}$ | 1.5 | 0.8 | 0.6 |
| 10 | 235 | 10 | $3.30 \times 10^{-9}$ | 1.6 | 0.7 | 0.5 |
| 11 | 224 | 12 | $3.40 \times 10^{-9}$ | 1.5 | 0.7 | 0.5 |
| 12 | 242 | 10.2 | $3.20 \times 10^{-9}$ | 1.6 | 0.7 | 0.5 |
| 13 | 230 | 11 | $3.60 \times 10^{-9}$ | 1.6 | 0.6 | 0.5 |
| 14 | 233 | 11 | $3.10 \times 10^{-9}$ | 1.4 | 0.7 | 0.4 |
| 15 | 245 | 9.8 | $2.90 \times 10^{-9}$ | 1.6 | 0.7 | 0.5 |
| 16 | 240 | 10.4 | $2.70 \times 10^{-9}$ | 1.7 | 0.7 | 0.4 |
| 17 | 247 | 9.6 | $2.80 \times 10^{-9}$ | 1.7 | 0.6 | 0.5 |
| 18 | 244 | 10 | $2.60 \times 10^{-9}$ | 1.6 | 0.6 | 0.5 |
| 19 | 235 | 11 | $3.50 \times 10^{-9}$ | 1.6 | 0.7 | 0.5 |
| 20 | 233 | 10.7 | $3.30 \times 10^{-9}$ | 1.6 | 0.7 | 0.5 |
| 21 | 236 | 10.4 | $2.90 \times 10^{-9}$ | 1.5 | 0.7 | 0.6 |
| 22 | 239 | 10 | $2.80 \times 10^{-9}$ | 1.5 | 0.8 | 0.6 |
| 23 | 230 | 11 | $3.60 \times 10^{-9}$ | 1.4 | 0.8 | 0.5 |
| 24 | 222 | 12.4 | $3.80 \times 10^{-9}$ | 1.6 | 0.7 | 0.5 |
| 25 | 227 | 12 | $4.20 \times 10^{-9}$ | 1.5 | 0.8 | 0.5 |
| 26 | 228 | 11.3 | $4.50 \times 10^{-9}$ | 1.4 | 0.7 | 0.6 |
| 27 | 215 | 13 | $4.40 \times 10^{-9}$ | 1.4 | 0.8 | 0.6 |
| 28 | 216 | 13.1 | $4.80 \times 10^{-9}$ | 1.6 | 0.7 | 0.6 |
| 29 | 240 | 9.9 | $3.20 \times 10^{-9}$ | 1.2 | 0.8 | 0.4 |

TABLE 3

| Sample No. | Evaluated Items: 300° C. Tensile Strength (MPa) | 300° C. Elongation (%) | 300° C. 80 MPa Minimum Creep Rate (l/s) | Si Grain Size (μm) | Grain Size of Compound Other than Si (μm) | Al Grain Size (μm) |
|---|---|---|---|---|---|---|
| Comparative Sample | | | | | | |
| 30 | 175 | 18 | $8.80 \times 10^{-8}$ | 2.7 | 1.4 | 2.2 |
| 31 | 220 | 11 | $9.20 \times 10^{-8}$ | 1.5 | 0.8 | 0.5 |
| 32 | 225 | 12.2 | $9.50 \times 10^{-8}$ | 1.6 | 0.8 | 0.5 |
| 33 | 214 | 14 | $1.20 \times 10^{-7}$ | 1.5 | 0.7 | 0.6 |
| 34 | 220 | 12.3 | $5.00 \times 10^{-8}$ | 1.5 | 0.7 | 0.5 |
| 35 | 207 | 13 | $4.00 \times 10^{-8}$ | 1.4 | 1.3 | 1.9 |
| 36 | 235 | 5 | $4.40 \times 10^{-8}$ | 2.3 | 1.3 | 1.8 |
| 37 | 233 | 3.9 | $5.00 \times 10^{-8}$ | 1.6 | 1.8 | 2.5 |
| 38 | 230 | 5.3 | $1.10 \times 10^{-7}$ | 3.3 | 1.5 | 2.3 |
| 39 | 235 | 8.5 | $5.80 \times 10^{-8}$ | 1.4 | 1.5 | 2.2 |
| 40 | 209 | 11.1 | $8.50 \times 10^{-8}$ | 2.2 | 0.9 | 1.4 |
| 41 | 225 | 11.1 | $8.30 \times 10^{-8}$ | 1.5 | 0.8 | 1.1 |
| 42 | 233 | 9.9 | $7.00 \times 10^{-8}$ | 1.6 | 0.8 | 1.1 |
| 43 | 208 | 9.9 | $6.80 \times 10^{-8}$ | 2 | 1 | 1.4 |
| 44 | 192 | 5.3 | $7.20 \times 10^{-8}$ | 2.2 | 0.9 | 1.3 |

Referring to Tables 2 and 3, the term "minimum creep rate" indicates the minimum inclination in a creep deformation property curve following measurement of strain varying with time under a constant temperature and a constant load, as shown in FIG. 9.

From the results shown in Tables 2 and 3, it has been proven that each of the inventive samples Nos. 1 to 29 has high tensile strength of at least 215 MPa at 300° C., large elongation of at least 9.6 % at 300° and a low minimum creep rate of not more than $8.50\times10^{-9}$ following application of tension of 80 MPa at 300° C. It has been also proven that the mean crystal grain size of silicon is not more than 2 μm the mean grain size of compounds other than silicon is not more than 1 μm and the mean crystal grain size of the aluminum matrix in at least 0.2 μm and not more than 2 μm in each of the inventive samples Nos. 1 to 29.

In each of comparative samples Nos. 30 to 44, the minimum creep rate was in excess of $8.50\times10^{-9}$ following application of tension of 80 MPa at 300° C. Tensile strength at 300° C. was lower than 215 MPa for each of comparative samples Nos. 30, 33, 35, 40, 43 and 44, while elongation at 300° C. was smaller than 9.6 % in each of comparative samples Nos. 36 to 39 and 44.

From the above results, it has been proved that an aluminum alloy having a composition in the range of the present invention attains excellent characteristics as to all of tensile strength at 300° C., elongation at 300° C. and the minimum creep rate following application of tension of 80 MPa at 300° C.

According to the heat-resistant, creep-resistant aluminum alloy and the method of preparing the same according to the present invention, as hereinabove described, excellent heat resistance and creep resistance can be attained due to the prescribed composition and the prescribed structure, whereby an aluminum alloy suitable as a piston or an engine part employable at a high temperature (particularly in excess of 300° C.) and required to have high creep resistance and a method of preparing the same can be obtained.

The embodiment and Experimental Example disclosed this time must be considered illustrative and not restrictive in all points. The scope of the present invention is shown not by the above description but by the scope of claim for patent, and it is intended that all modifications in meanings and ranges equivalent to the scope of claim for patent are included.

Industrial Availability

As hereinabove described, the present invention is suitably applied to a member such as a piston, for example, required to have heat resistance and creep resistance.

What is claimed is:

1. A heat-resistant, creep-resistant aluminum alloy consisting of at least 10 mass % and not more than 30 mass % of silicon, at least 3 mass % and not more than 5 mass % in total of at least one element selected from the group consisting of iron and nickel, at least 1 mass % and not more than 6 mass % of at least one rare earth element in total and at least 1 mass % and not more than 3 mass % of zirconium with the rest consisting of aluminum and unavoidable impurities, and wherein the mean crystal grain size of silicon is not more than 2 μm, the mean grain size of compounds other than said silicon is not more than 1 μm, and the mean crystal grain size of an aluminum matrix is at least 0.2 μm and not more than 2 μm.

2. A billet of a heat-resistant, creep-resistant aluminum alloy consisting of at least 10 mass % and not more than 30 mass % of silicon, at least 3 mass % and not more than 5 mass % in total of at least one element selected from the group consisting of iron and nickel, at least 1 mass % and not more than 6 mass % of at least one rare earth element in total and at least 1 mass % and not more than 3 mass % of zirconium, with the rest consisting of aluminum and unavoidable impurities, said billet having a substantially cylindrical shape.

3. The billet of a heat-resistant, creep-resistant aluminum alloy according to claim 2, wherein elongation at 300° C. is at least 1% and not wore than 7%.

4. The billet of a heat-resistant, creep-resistant aluminum alloy according to claim 2, wherein elongation at 300° C. is at least 7% and not wore than 15%.

5. A heat-resistant, creep-resistant aluminum alloy consisting of at least 10 mass % and not more than 30 mass % of silicon, at least 3 mass % and not more than 5 mass % in total of at least one element selected from the group consisting of iron and nickel, only said nickel being optional and a percentage content of said iron being at least 1 mass %, at least 10 mass % and not more than 6 mass % of at least one rare earth element in total, at least 1 mass % and not more than 3 mass % of zirconium, and at least 0.5 mass % and not more than 5 mass % of at least one element selected from a group consisting of cobalt, chromium, molybdenum, tungsten and vanadium in total, with the rest consisting of aluminum and unavoidable impurities, and wherein the mean crystal grain size of silicon is not more than 2 $\mu$m, the mean grain size of compounds other than said silicon is not more than 1 $\mu$m, and the mean crystal grain size of an aluminum matrix is at least 0.2 $\mu$m and not more than 2 $\mu$m.

6. A billet of a heat-resistant, creep-resistant aluminum alloy consisting of at least 10 mass % and not more than 30 mass % of silicon, at least 3 mass % and not more than 5 mass % in total of at least one element selected from the group consisting of iron and nickel, only said nickel being optional and a percentage content of said iron being at least 1 mass %, at least 1 mass % and not more than 6 mass % of at least one rare earth element in total and at least 1 mass % and not more than 3 mass % of zirconium and at least 0.5 mass % and not more than 5 mass % of at least one element selected from a group consisting of cobalt, chromium, molybdenum, tungsten and vanadium in total, with the rest consisting of aluminum and unavoidable impurities, said billet having a substantially cylindrical shape.

7. The billet of a heat-resistant, creep-resistant aluminum alloy according to claim 6, wherein elongation at 300° C. is at least 1% and not more than 7%.

8. The billet of a heat-resistant, creep-resistant aluminum alloy according to claim 6, wherein elongation at 300° C. is at least 7% and not more than 15%.

* * * * *

UNITED STATES PATENT AND TRADEMARK OFFICE

CERTIFICATE OF CORRECTION

PATENT NO. : 6,962,673 B2
DATED : November 8, 2005
INVENTOR(S) : Hattori et al.

It is certified that error appears in the above-identified patent and that said Letters Patent is hereby corrected as shown below:

Title page,
Item [57] ABSTRACT,
Line 4, after "than" replace "10" by -- 5 --;

Column 1,
Line 7, replace "TECHNICAL" by -- FIELD --;
Line 58, after "consisting of" replace "aluminu" by -- aluminum --;
Line 61, after "1 μm" replace "arid" by -- and --;

Column 2,
Lines 30 and 31, after "iron is" replace "Converted" by -- converted --;

Column 3,
Line 13, after "molybdenum" replace "(No)" by -- (Mo) --;
Line 13, after "vanadium" replace "CV)" by -- (V) --;
Line 23, after "at least" replace "10" by -- 1 --;
Line 53, after "rest", replace "Substantially" by -- substantially --;

Column 5,
Line 22, after "10 mass" replace "10" by -- % --;

Column 6,
Line 26, replace "learnt" by -- least --;
Lines 30 to 41, delete paragraph;

Column 9, line 49 to Column 10, line 4,
delete paragraph;

UNITED STATES PATENT AND TRADEMARK OFFICE

CERTIFICATE OF CORRECTION

PATENT NO. : 6,962,673 B2
DATED : November 8, 2005
INVENTOR(S) : Hattori et al.

It is certified that error appears in the above-identified patent and that said Letters Patent is hereby corrected as shown below:

Column 15,
Lines 3 and 6, after "not" replace "wore" by -- more --;
Line 13, after "least" first occurrence, replace "10" by -- 1 --.

Signed and Sealed this

Thirtieth Day of May, 2006

JON W. DUDAS
*Director of the United States Patent and Trademark Office*